US009654892B2

(12) United States Patent
Akino

(10) Patent No.: US 9,654,892 B2
(45) Date of Patent: May 16, 2017

(54) CONDENSER MICROPHONE

(71) Applicant: KABUSHIKI KAISHA AUDIO-TECHNICA, Machida-shi, Tokyo (JP)

(72) Inventor: Hiroshi Akino, Machida (JP)

(73) Assignee: KABUSHIKI KAISHA AUDIO-TECHNICA, Machida-shi, Tokyo (JP)

( * ) Notice: Subject to any disclaimer, the term of this patent is extended or adjusted under 35 U.S.C. 154(b) by 0 days.

(21) Appl. No.: 15/145,411

(22) Filed: May 3, 2016

(65) Prior Publication Data

US 2016/0337753 A1 Nov. 17, 2016

(30) Foreign Application Priority Data

May 15, 2015 (JP) ..... 2015-099645

(51) Int. Cl.
*H04R 31/00* (2006.01)
*H04R 19/04* (2006.01)
*H04R 1/02* (2006.01)

(52) U.S. Cl.
CPC ..... *H04R 31/00* (2013.01); *H04R 19/04* (2013.01); *H04R 1/028* (2013.01)

(58) Field of Classification Search
CPC ..... H04R 31/00; H04R 19/04; H04R 1/028
See application file for complete search history.

(56) References Cited

U.S. PATENT DOCUMENTS

2003/0007650 A1* 1/2003 Akino ..... H04R 19/04 381/113

FOREIGN PATENT DOCUMENTS

JP 5409293 B2 2/2014

* cited by examiner

*Primary Examiner* — Ping Lee
(74) *Attorney, Agent, or Firm* — Manabu Kanesaka

(57) ABSTRACT

A condenser microphone utilizes a PLL circuit which includes a phase shift oscillator having an RC network that uses an electrostatic capacitance of the condenser microphone unit varying upon reception of a sound pressure and a resistance value of a variable resistance element; a phase detection unit that compares phases of a fixed frequency signal from a reference signal oscillator and an oscillation output signal from the phase shift oscillator and outputs a phase difference signal corresponding to a phase difference; a loop filter that extracts a control signal when receiving the phase difference signal from the phase detection unit; and a driver circuit that changes a resistance value of the variable resistance element provided in the phase shift oscillator based on the control signal obtained from the loop filter. The control signal obtained from the loop filter of the PLL circuit is used as an audio output signal.

10 Claims, 4 Drawing Sheets

CONDENSER MICROPHONE

RELATED APPLICATIONS

The present application is based on, and claims priority from, Japanese Application No. JP2015-099645 filed May 15, 2015, the disclosure of which is hereby incorporated by reference herein in its entirety.

BACKGROUND OF THE INVENTION

Field of the Invention

The present invention relates to a condenser microphone that generates an electrostatic capacitance change of a condenser microphone unit as a voice output signal using a phase locked loop (PLL).

Description of the Related Art

The condenser microphone has a condenser type microphone unit having a combination of a diaphragm and a fixed electrode, and extracts the electrostatic capacitance change accompanying displacement of the diaphragm caused by a sound wave as the electric signal. Therefore, a direct current (DC) voltage is applied between the diaphragm and the fixed electrode. This DC voltage is called a polarization voltage. As for methods for applying the polarization voltage, a method for applying a voltage from the outside of the microphone unit and a method for giving the polarization voltage by means of an electret material are generally used.

In addition, since the condenser microphone unit has very high impedance between the diaphragm and the fixed electrode, it is configured to obtain the sound signal using an impedance converter that uses an FET or a vacuum tube.

However, the conventional condenser microphone is susceptible to an external electric field and an external magnetic field when converting the electrostatic capacitance change into a voltage. Moreover, since the impedance converter is used, a noise resulting from electric charge leakage intrinsic to the impedance converter is generated, for example, when surrounding humidity is high.

Furthermore, an electret type condenser microphone unit can be small in size in order to be used for a cellular phone, for example. However, since the electret is sensitive to heat, a reflow solder method cannot be applied to this when being mounted on a substrate. Therefore, the electret type condenser microphone unit was mounted separately from chip components, such as resistors and capacitors, which caused an increase of man-hour for the mounting.

In view of this, Japanese Patent No. 5409293 discloses a circuit configuration that converts the electrostatic capacitance change of the microphone unit into the voice output signal using a PLL circuit without using an electret.

FIG. 5 is a principal part of a circuit configuration disclosed in Japanese Patent No. 5409293. In this example, a three-stage RC network including resistors R and capacitors C and a phase shift oscillator containing an inverting amplifier are used. An output signal of this phase shift oscillator is used as a phase synchronization signal of the PLL circuit.

As shown in FIG. 5, a diaphragm 1 that configures the condenser microphone unit is attached to a diaphragm ring 2. A electrically conductive film (not shown) formed on the diaphragm 1 is connected to the ground. Moreover, the fixed electrode confronting the back side of the diaphragm 1 is divided into first to third fixed electrode pieces 3*a*, 3*b*, and 3*c* each of which is fan shaped. Therefore, three electrostatic capacitors C1, C2, and C3 that are formed between the diaphragm 1 and the respective fixed electrode pieces 3*a*, 3*b*, and 3*c* are used as capacitors of the RC network.

Furthermore, fixed resistors R1, R2, and R3 are connected, respectively, between an output terminal of the inverting amplifier 4 and the first fixed electrode piece 3*a*, between the first fixed electrode piece 3*a* and the second fixed electrode piece 3*b*, and between the second fixed electrode piece 3*b* and the third fixed electrode piece 3*c*, and the third fixed electrode piece 3*c* is connected to an input terminal of the inverting amplifier 4. Thus, the three-stage RC network mentioned above is formed.

Then a signal corresponding to an electrostatic capacitance of the condenser microphone unit is supplied to the PLL circuit from the output terminal of the inverting amplifier 4 as a phase synchronization signal.

The PLL circuit includes a phase comparator 5, a charge pump 6, a loop filter 7, and a voltage-controlled oscillator 8. A control signal obtained by the loop filter 7 of this PLL circuit is brought to an output terminal OUT and this signal is used as the audio output signal of the condenser microphone.

According to this, since the electrostatic capacitance change is not converted into a voltage, the condenser microphone is hard to be affected by influences of the surrounding electromagnetic fields, and a noise by the electric charge leakage of the impedance converter does not occur, either. Furthermore, since the polarization voltage by the electret material and the like is not needed, surface mounting by the reflow solder method together with chip components, such as resistors, and capacitors also becomes possible.

SUMMARY OF THE INVENTION

Incidentally, according to a condenser microphone disclosed in Japanese Patent No. 5409293, an output signal of a phase shift oscillator that oscillates corresponding to an electrostatic capacitance of its condenser microphone unit is used as a phase synchronization signal of the PLL circuit. Values of the electrostatic capacitors C1, C2, and C3 and the fixed resistors R1, R2, and R3 mentioned above used for this phase shift oscillator have temperature dependence. Therefore, the oscillation output signal of the phase shift oscillator having these components is affected by a relatively large influence of temperature drift.

When the oscillation output signal that was affected by such a temperature drift is used as the phase synchronization signal of the PLL circuit, failures such as unlocking from a lock-in range of the PLL occurs due to temperature drift in this PLL circuit. Then, output as an audio signal of the microphone becomes impossible.

Therefore, as for the phase synchronization signal of the PLL circuit mentioned above, a phase synchronization signal is desirable which is not affected by the temperature drift mentioned above, for example, and has a stable oscillation frequency. Especially when being used in the microphone, in a silent state where no sound wave is applied to the diaphragm, a PLL circuit is desirably set in a state where an output of a phase difference signal from the phase comparator is absent and the PLL circuit is locked to a stable phase synchronization signal that is free from frequency change.

The present invention provides a condenser microphone that enables surface-mounting using a reflow solder method because the polarization voltage by the electret material is not necessary, which is the above mentioned original effect obtained by using the PLL circuit. Further, the present invention provides a condenser microphone that is not affected by the temperature drift, for example, as was disclosed in Japanese Patent No. 5409293.

In a condenser microphone according to the invention to solve the above problem, a phase locked loop includes:

a phase shift oscillator having an RC network that uses an electrostatic capacitance C of a condenser microphone unit varying upon reception of a sound pressure and a resistance value R of a variable resistive element;

a phase detection unit that outputs a phase difference signal corresponding to phase difference which is obtained by comparing phases of a fixed frequency signal from a reference signal oscillator and of an oscillator output signal of the phase-shift oscillator;

a loop filter that extracts a control signal upon reception of the phase difference signal from the phase detection unit; and a driver circuit that changes the resistance value of the variable resistance element provided in the phase shift oscillator based on the control signal obtained from the loop filter, wherein the control signal obtained from the loop filter of the phase locked loop is used as an audio output signal.

In this case, the phase shift oscillator includes an inverting amplifier and a multiple-stage RC network that includes electrostatic capacitors of the condenser microphone unit and the variable resistance elements both of which are connected between the output terminal and the input terminal of the inverting amplifier.

Further, in one preferred embodiment, a light emitting diode is connected to the driver circuit and a photoconductive element that receives light from the light emitting diode is used as the variable resistance element.

More preferably, a plurality of light emitting diodes is connected in series to the driver circuit, and a plurality of photoconductive elements whose number is equal to that of the light emitting diodes is used for the variable resistance elements that configure the multiple-stage RC network, respectively. Furthermore, a photo coupler is configured by pairing each of the light emitting diodes and each of the photoconductive elements make a pair, respectively.

Further, in a condenser microphone according to the invention to solve the above problem, a phase locked loop includes: a condenser microphone unit having a fixed electrode and a diaphragm, a phase shift oscillator having an RC network configured from a combination of a capacitor configured by the condenser microphone unit whose electrostatic capacitance C varies upon reception of a sound pressure and a variable resistance element; a phase detection unit that an outputs phase difference signal corresponding to phase difference which is obtained by comparing phases of a fixed frequency signal from a reference signal oscillator and of an oscillator output signal of the phase-shift oscillator; a loop filter that extracts a control signal upon reception of the phase difference signal from the phase detection unit; and a driver circuit that changes the resistance value of the variable resistance element provided in the phase shift oscillator based on the control signal obtained from the loop filter, wherein the control signal obtained from the loop filter of the phase locked loop is used as an audio output signal.

In this case, a light emitting diode is connected to the driver circuit, and a photoconductive element receiving light from the light emitting diode is used for the variable resistance element.

Further, the fixed electrode configures a plurality of the capacitors by the fixed electrode being configured from a plurality of fixed electrode pieces, the variable resistance elements whose number is equal to that of the plurality of capacitors are provided, and the phase shift oscillator has a plurality of stages of RC network in each of which the each capacitor and the each variable resistive element make one pair.

In addition, a plurality of light emitting diodes are connected in series to the driver circuit, photoconductive elements whose number is identical to that of the light emitting diodes are used for variable resistive elements that configure the multiple-stage RC networks, and each of the light emitting diodes and each of the photoconductive elements make a pair, respectively, to configure a photocoupler, respectively.

Further, in a preferred embodiment, the numbers of the plurality of fixed electrode pieces, the plurality of variable resistive elements, and the plurality of light emitting diodes are three, respectively.

In addition, the phase shift oscillator further desirably includes an inverting amplifier and the RC network is connected between the output terminal and the input terminal of the inverting amplifier.

According to the condenser microphone of the configuration mentioned above, the PLL circuit is used whose phase is locked by a fixed frequency signal from a reference signal oscillator, and an output signal of the phase shift oscillator using the electrostatic capacities of the condenser microphone unit and the variable resistive elements is used as a feedback signal. Then a control signal obtained from the loop filter of the PLL circuit is used as an audio output signal.

According to the configuration that uses this PLL circuit, similar to the condenser microphone disclosed in Japanese Patent No. 5409293, it is possible to provide a condenser microphone that utilizes special properties as follows: the configuration is not susceptible to influences of external electromagnetic fields; the configuration is not affected by a noise caused by electric charge leakage of the impedance converter; the configuration makes possible the surface mounting by the reflow solder method because it needs no polarization voltage by such as an electret material.

Since the PLL circuit is set in a state of being locked to a phase synchronization signal that has no frequency variation and is stable, it becomes possible to provide a condenser microphone that does not bring about a problem of unlocking caused by the temperature drift, for example, as compared with the condenser microphone disclosed in Japanese Patent No. 5409293.

DESCRIPTION OF THE PREFERRED EMBODIMENTS

Figure 1:
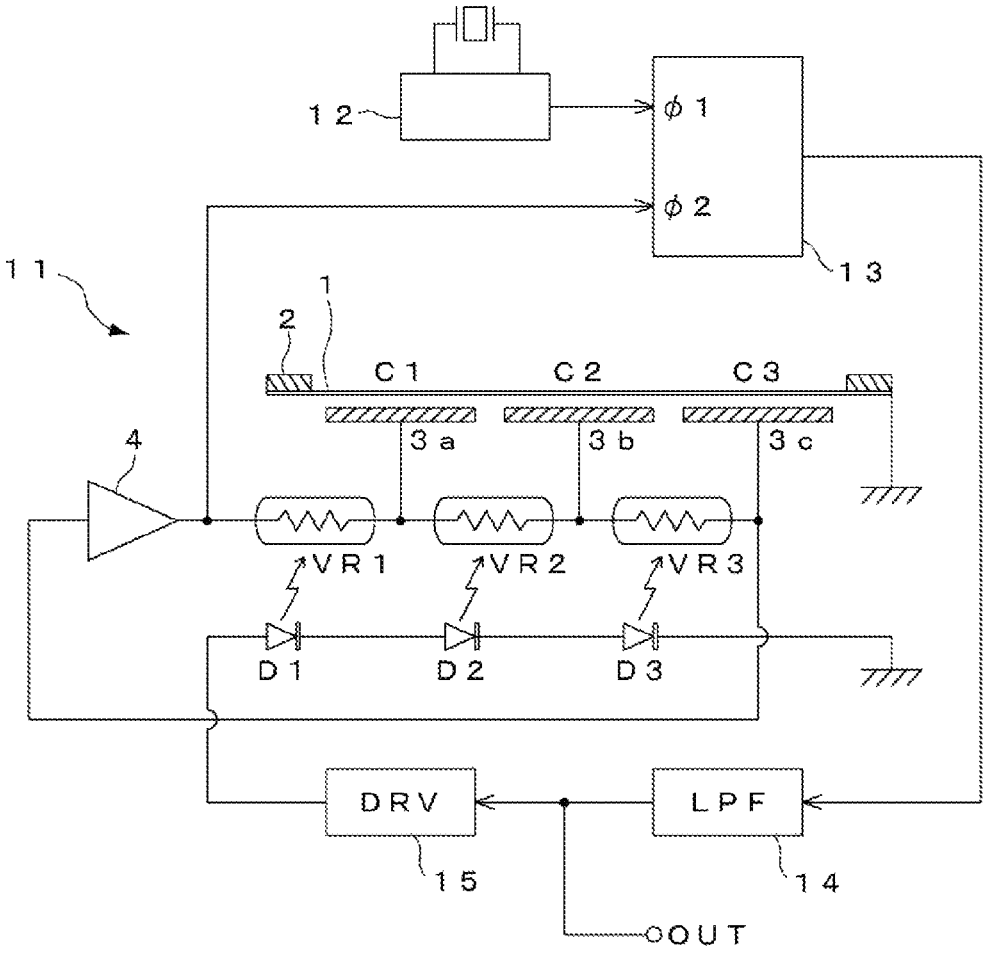
FIG. 1 is a circuit configuration diagram showing a first embodiment of a condenser microphone according to the present invention.
Figure 2:
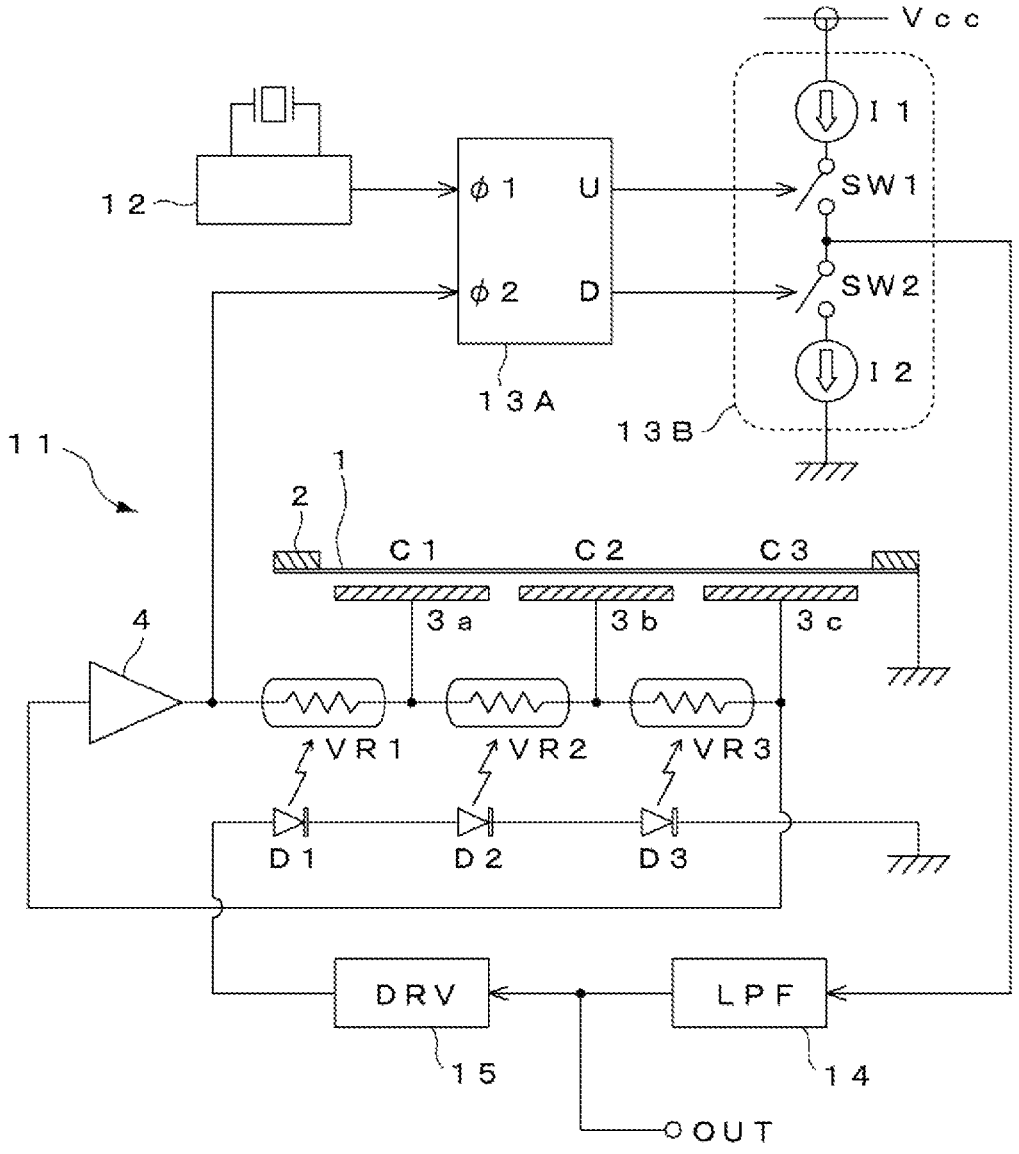
FIG. 2 is a circuit configuration diagram showing a second embodiment of a condenser microphone according to the present invention.

Regarding a condenser microphone according to the present invention, explanation of a first embodiment shown in FIG. 1 and the other explanation for a second embodiment shown in FIG. 2 will separately be given.

Firstly, the first embodiment shown in FIG. 1 shows an example in which an analog PLL circuit is used for demodulation of an audio signal of the condenser microphone.

As shown in FIG. 1, a diaphragm 1 that configures the condenser microphone unit is attached to a diaphragm ring 2, and an conducting film (not shown) formed on the diaphragm 1 is connected to the ground. Moreover, the fixed electrode that confronts the back side of the diaphragm 1 is divided into first to third fixed electrode pieces 3*a*, 3*b*, and 3*c* each of which is fan shaped, respectively, and three independent electrostatic capacities C1, C2, and C3 are formed between the diaphragm 1 and the respective fixed electrode pieces 3*a*, 3*b*, and 3*c*.

Then variable resistance elements VR1, VR2, and VR3 using the photoconductive elements, for example, CdS, are connected between an output terminal of an inverting amplifier 4 and the first fixed electrode piece 3*a*, between the first fixed electrode piece 3*a* and the second fixed electrode piece 3*b*, and between the second fixed electrode piece 3*b* and the third fixed electrode piece 3*c*. Moreover, the third fixed electrode piece 3*c* is connected to an input terminal of the inverting amplifier 4.

Therefore, a three-stage RC network formed of the three independent electrostatic capacities C1, C2, and C3 and variable resistive elements VR1, VR2, and VR3 using the photoconductive elements is connected between an output terminal of the inverting amplifier 4 and the input terminal thereof.

That is, the output signal of the inverting amplifier 4 is fed back to the input terminal of the inverting amplifier 4 with its phase shifted by 180° by the three-stage RC network. Therefore, positive feedback is applied to the inverting amplifier 4. Thereby, a phase shift oscillator 11 is constructed with the inverting amplifier 4 and the three-stage RC network mentioned above. A signal corresponding to an electrostatic capacitance of the condenser microphone unit, namely, an oscillation output corresponding to the sound signal is brought to the output terminal of the inverting amplifier 4.

Incidentally, although in the phase shift oscillator 11 mentioned above, a three-stage RC network is used as one example, the phase shift oscillator 11 can be configured using a multiple-stage RC network together with the inverting amplifier 4 if a phase condition is met. This is also the same in a second embodiment that will be described below.

In contrast, the condenser microphone of FIG. 1 is also provided with a reference signal oscillator 12 for generating a fixed frequency signal using a crystal oscillator. The fixed frequency signal from this reference signal oscillator 12 is supplied to an analog phase comparator 13 working as a phase detection unit that configures the PLL circuit. Moreover, a signal from the phase shift oscillator 11 including the condenser microphone unit mentioned above is also supplied to the analog phase comparator 13 as a feedback signal.

The phase comparator 13 as the phase detection unit mentioned above detects a phase difference between the fixed frequency signal from the reference signal oscillator 12 and the signal from the phase shift oscillator 11, and generates an output (phase difference signal) corresponding to the phase difference. The phase difference signal from the phase comparator 13 is outputted as a control signal through a loop filter 14 configured from a low pass filter.

Then the control signal from the loop filter 14 is supplied to a driver circuit 15, and the driver circuit 15 supplies a light emission driving current based on the control signal to the first to third light emitting diodes D1, D2, and D3 that are connected in series.

Incidentally, in this embodiment, the first to third light emitting diodes D1, D2, and D3 are respectively disposed so as to make pairs to the variable resistance elements, made of the photoconductive elements, VR1, VR2, and VR3 that are provided in the phase shift oscillator 11 mentioned above. Each pair forms a first to a third photocoupler, respectively.

Therefore, resistance values of the variable resistance elements VR1, VR2, and VR3, made of the photoconductive elements, that configure the phase shift oscillator 11 are controlled by the light emission driving current from the driver circuit 15 based on the control signal mentioned above.

Thereby, an oscillation frequency of the phase shift oscillator 11 depends on the control signal output from the loop filter 14 mentioned above and the phase shift oscillator 11 functions as a voltage-controlled oscillator (VCO) of the PLL circuit.

According to the configuration shown in FIG. 1, the phase shift oscillator 11 functions as the voltage-controlled oscillator (VCO) of the PLL circuit. Therefore, in a silent state where a sound pressure is not applied to the diaphragm 1 of the condenser microphone, an operation of the PLL circuit by the phase comparator 13, the loop filter 14, the driver circuit 15, and the phase shift oscillator 11 is stabilized to be locked to the fixed frequency signal from the reference signal oscillator 12.

Therefore, the fixed frequency signal from the reference signal oscillator 12 applied to the phase comparator 13 and an oscillation signal of the phase shift oscillator 11 are in phase. Thereby, the phase difference signal is not generated in the phase comparator 13 and no output of the condenser microphone as an audio output signal thereof appears at an output terminal OUT of the loop filter 14.

On the other hand, when the sound pressure is applied to the diaphragm 1 of the condenser microphone, the oscillation output by the phase shift oscillator 11 varies corresponding to the sound pressure. Therefore, a phase difference signal occurs in the phase comparator 13, and the control signal is generated based on the phase difference signal through the loop filter (low pass filter) 15.

This control signal is inputted into the driver circuit 15, and drives the first to third photocouplers. As a result, the variable resistance elements VR1, VR2, and VR3 are controlled and the phase shift oscillator 11 operates so as to follow the fixed frequency signal from the reference signal oscillator 12 mentioned above.

The control signal outputted to the output terminal OUT is used as the audio output signal of the condenser microphone.

Next, an embodiment shown in FIG. 2 shows an example in which a digital PLL circuit is used for demodulation of the audio signal of the condenser microphone.

In the example shown in this FIG. 2, in place of the analog phase comparator 13 serving as the phase detection unit shown in FIG. 1, for example, a phase comparator 13A using a NOR gate and a charge pump 13B are used to configure the phase detection unit. Then a configuration of the phase shift oscillator 11 that includes the loop filter 14, the driver circuit 15, the diaphragm 1 of the condenser microphone becomes the same as that of the example shown in FIG. 1.

Therefore, explanations about configurations of the loop filter 14, the driver circuit 15, and the phase shift oscillator 11 are omitted.

The fixed frequency signal from the reference signal oscillator 12 using the crystal resonator (also called a reference signal) is supplied to the phase comparator 13A that configures the phase detection unit. Moreover, the signal from the phase shift oscillator 11 that includes the condenser microphone unit mentioned above is also supplied to the phase comparator 13A as the feedback signal.

The phase comparator 13A compares phases of the reference signal and the feedback signal. Then the phase comparator 13A outputs a first control signal S1 that will be described later to a first output terminal U when the feedback signal has a phase delay to the reference signal, and outputs a second control signal S2 that will be described later to a second output terminal D when the return signal has a phase advance to the reference signal.

Incidentally, the phase comparator 13A used in this embodiment is a phase frequency comparator that operates at the rising edge of a waveform of the input signal. For the phase comparator 13A, an integrated circuit MC4044 manufactured by Motorola, Inc. is used, for example.

On the other hand, the charge pump 13B is provided with a pair of switching elements SW1, SW2. Then a common connection node of the switching elements SW1, SW2 becomes an output terminal of the charge pump 13B. The one switching element SW1 is connected to a power supply Vcc through a current regulating circuit I1, and the other switching element SW2 is connected to the ground through a constant current circuit I2.

Then, when the first control signal S1 is outputted to the first output terminal U of the phase comparator 13A, the switching element SW1 of the charge pump 13B becomes an on state. A current defined by the current regulating circuit I1 is sent from the power supply Vcc in the device to the loop filter 14 through the switching element SW1.

Moreover, when the second control signal S2 is outputted to the second output terminal D of the phase comparator 13A, the switching element SW2 of the charge pump 13B turns on. At this time, a current defined by the current regulating circuit I2 is led to the ground from the loop filter 14 through the switching element SW2.

The action mentioned above generates the phase difference signal in the output terminal of the charge pump 13B. This phase difference signal is outputted as the control signal through the loop filter 14 configured from the low pass filter. Then the control signal from the loop filter 14 is supplied to the driver circuit 15. The driver circuit 15 supplies the light emission driving current based on the control signal to the first to third light emitting diodes D1, D2, and D3 connected in series.

Thereby, the oscillation frequency of the phase shift oscillator 11 depends on the control signal output from the loop filter 14 mentioned above and the phase shift oscillator 11 functions as the voltage-controlled oscillator (VCO) of the PLL circuit.

Figure 3:
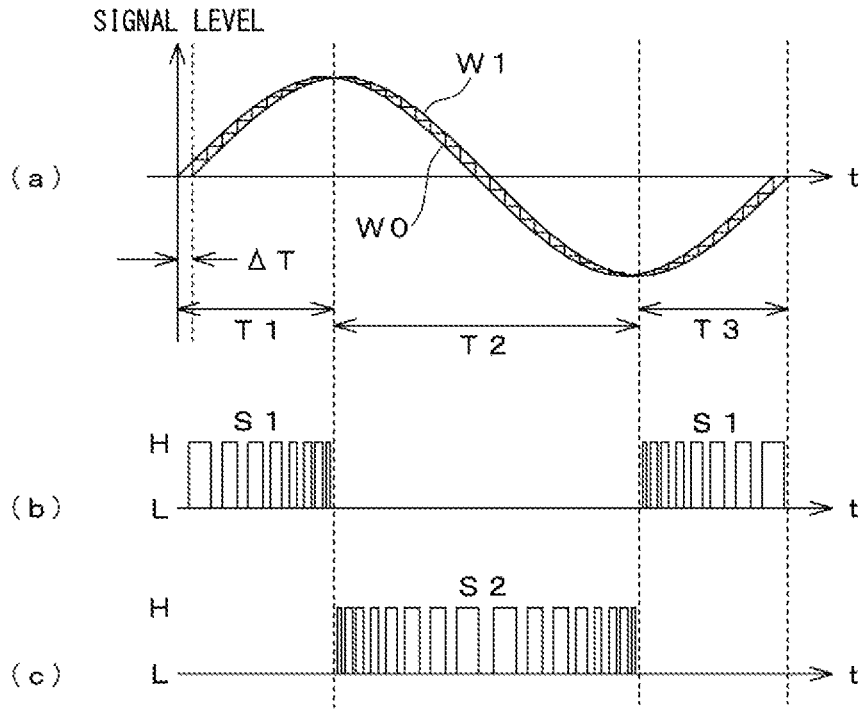
FIG. 3 is signal waveform diagrams for illustrating signal processing that is performed in a phase detection unit of the second embodiment.
Figure 4:
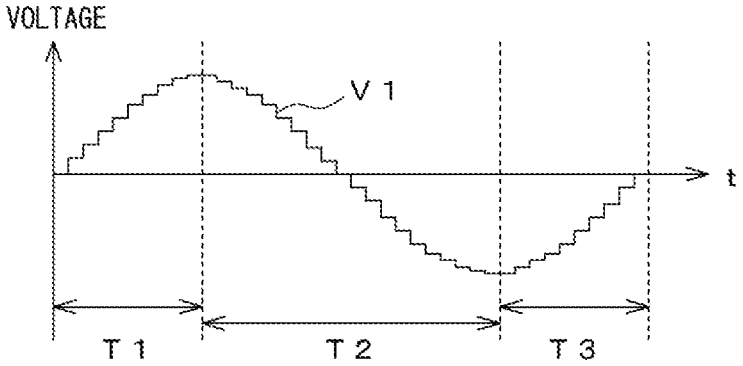
FIG. 4 is a waveform chart of a phase difference signal output from the phase detection unit of the second embodiment.
Figure 5:
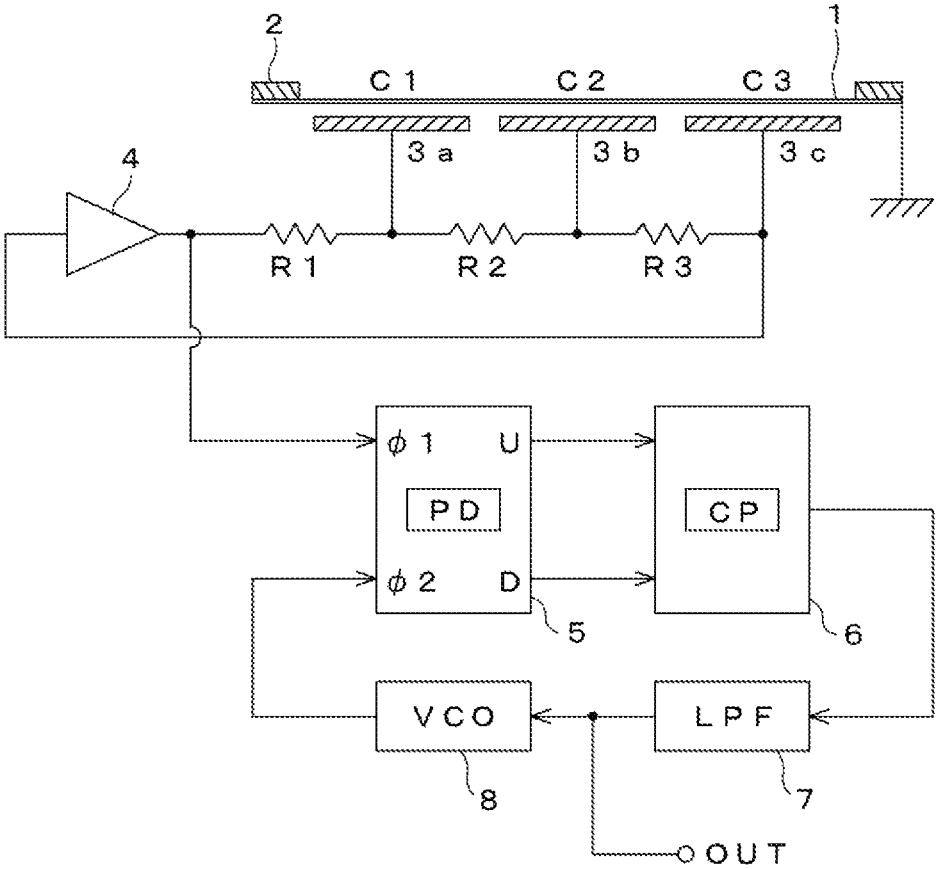
Fig. 5 Prior Art
FIG. 5 is a circuit configuration diagram showing one example of the conventional condenser microphone.

FIG. 3 and FIG. 4 are signal waveform diagrams for describing actions of the phase comparator 13A and the charge pump 13B mentioned above.

FIG. 3(*a*) shows a relationship between a reference signal W0 from the reference signal oscillator 12 and a feedback signal W1 from the phase shift oscillator 11 that are applied to the phase comparator 13A.

Although the phase comparator 13A compares phases of the reference signal W0 and the feedback signal W1 from a difference of the respective signal levels at the same time, there is a propagation time in the PLL circuit mentioned above. Therefore, in order for the feedback signal W1 to have the same oscillation frequency as that of the reference signal W0, a time equal to a time difference ΔT will be required.

Therefore, in an interval T1 and an interval T3 shown in FIG. 3(*a*), the signal level of the reference signal W0 is larger than the signal level of the feedback signal W1.

Thereby, as shown in FIG. 3(*b*), in the interval T1 and the interval T3, the first control signal S1 is outputted only from the first output terminal U of the phase comparator 13A. A pulse width of this first control signal S1 varies in proportion to a difference of the signal levels of the W0 and the W1.

In contrast, in an interval T2, the signal level of the reference signal W0 is smaller than the signal level of the feedback signal W1.

Therefore, as shown in FIG. 3(*c*), in the interval T2, the second control signal S2 is outputted only from the second output terminal D of the phase comparator 13A. The pulse width of the second control signal S2 also varies corresponding to the difference of the signal levels.

In this way, the phase comparator 13A detects a phase difference between the reference signal W0 and the feedback signal W1 from the signal level difference between the reference signal W0 and the feedback signal W1, and outputs the first and second control signals S1, S2, from the first output terminal U and the second output terminal D, respectively, whose pulse widths correspond to the phase difference. As a result, a signal of the same format as that of a signal that was subjected to PWM (Pulse Width Modulation) is inputted into the charge pump 13B.

The switching elements SW1, SW2 of the charge pump 13B are turned on and off by these first and second control signals S1, S2 and a voltage V1 as shown in FIG. 4 appears as a phase difference signal in the output terminal of the charge pump 13B.

That is, in the intervals T1, T3 where the first control signal S1 is outputted, the voltage V1 rises stepwise corresponding to the pulse width of the first control signal S1; and in the section T2 when the second control signal S2 is outputted, the voltage V1 decreases stepwise corresponding to the pulse width of the second control signal S2.

Harmonic components and noises included in the voltage V1 are removed with the loop filter (low pass filter) 14, and the voltage V1 becomes to be the control signal. This control signal is outputted to the output terminal OUT as the audio output signal of the condenser microphone.

The control signal from the loop filter 14 is supplied to the driver circuit 15 as described above. The driver circuit 15 controls the oscillation frequency of the phase shift oscillator 11 by driving the light emitting diodes D1, D2, and D3 to emit light according to the control signal. Thereby, the phase shift oscillator 11 operates so as to oscillate following the same frequency as that of the reference signal brought from the reference signal oscillator 12.

According to the condenser microphone including the PLL circuit mentioned above, when the sound pressure is applied to the diaphragm 1, a phase difference signal V1 corresponding to the sound pressure is outputted from the phase detection unit configured from the phase comparator 13A and the charge pump 13B. Then the phase difference signal V1 is outputted to the output terminal OUT as the audio output signal of the condenser microphone through the loop filter 14.

In other words, according to this condenser microphone, in the silent state where the sound pressure is not applied to the diaphragm 1, the operation of the PLL circuit becomes a stable state being locked to the fixed frequency signal (reference signal) from the reference signal oscillator 12.

Therefore, the phase difference signal V1 is not generated at this time, and the condenser microphone has no output as the audio output signal thereof completely in the output terminal OUT.

In the embodiments described above, the configuration in which the first to third light emitting diodes D1, D2, and D3 are disposed so as to pair with the variable resistive elements VR1, VR2, and VR3 that use the photoconductive elements provided in the phase shift oscillator 11, respectively, is adopted. However, a configuration in which three variable resistive elements using the photoconductive elements are disposed to a single light emitting diode can also be adopted. Moreover, in place of the variable resistive elements using the photoconductive elements, an active element such as an FET and a bipolar transistor whose resistance value is substantially varied by varying its gate voltage or base voltage can also be used.

What is claimed is:

1. A condenser microphone having a phase locked loop comprising:

a phase shift oscillator having an RC network that uses an electrostatic capacitance C of a condenser microphone unit varying upon reception of a sound pressure and a resistance value R of a variable resistance element;

a phase detection unit that compares phases of a fixed frequency signal from a reference signal oscillator and an oscillation output signal from the phase shift oscillator, and outputs a phase difference signal corresponding to a phase difference therebetween;

a loop filter that extracts a control signal when the phase difference signal from the phase detection unit is received; and a driver circuit that changes the resistance value of the variable resistance element provided in the phase shift oscillator based on the control signal obtained from the loop filter, wherein the control signal obtained from the loop filter of the phase locked loop is used as an audio output signal.

2. The condenser microphone according to claim 1, wherein the phase shift oscillator includes an inverting amplifier and a multiple-stage RC network that includes electrostatic capacities of the condenser microphone unit and the variable resistance elements connected between the output terminal and the input terminal of the inverting amplifier.

3. The condenser microphone according to claim 1, wherein a light emitting diode is connected to the driver circuit and a photoconductive element that receives light from the light emitting diode is used as the variable resistance element.

4. The condenser microphone according to claim 2, wherein a plurality of light emitting diodes are connected in series to the driver circuit, photoconductive elements whose number is equal to that of the light emitting diodes are used for variable resistance elements that configure the multiple-stage RC network, respectively, and each of the light emitting diodes and each of the photoconductive elements make a pair to configure a photocoupler, respectively.

5. A condenser microphone having a phase locked loop comprising:

a phase shift oscillator that has a condenser microphone unit having an fixed electrode and a diaphragm, and an RC network configured from a combination of the condenser microphone unit whose electrostatic capacitance C varies upon reception of a sound pressure as a capacitor and a variable resistance element;

a phase detection unit that compares phases of a fixed frequency signal from a reference signal oscillator and an oscillation output signal from the phase shift oscillator, and outputs a phase difference signal corresponding to a phase difference;

a loop filter that extracts a control signal when the phase difference signal from the phase detection unit is received; and a driver circuit that changes a resistance value of the variable resistance element provided in the phase shift oscillator based on the control signal obtained from the loop filter, wherein the control signal obtained from the loop filter of the phase locked loop is used as an audio output signal.

6. The condenser microphone according to claim 5, wherein a light emitting diode is connected to the driver circuit, and a photoconductive element for receiving light from the light emitting diode is used for the variable resistive element.

7. The condenser microphone according to claim 5, wherein the fixed electrode configures a plurality of the capacitors by the fixed electrode being configured from a plurality of fixed electrode pieces, the variable resistive elements whose number is equal to that of the plurality of capacitors are provided, and the phase shift oscillator has a plurality of stages of RC networks in each of which the each capacitor and the each variable resistive element make one pair.

8. The condenser microphone according to claim 7, wherein a plurality of light emitting diodes are connected in series to the driver circuit, photoconductive elements whose number is equal to that of the light emitting diodes are used for variable resistive elements that configure the multiple-stage RC networks, and each of the light emitting diodes and each of the photoconductive elements make a pair to configure a photocoupler, respectively.

9. The condenser microphone according to claim 8, wherein the numbers of the plurality of fixed electrode pieces, the plurality of variable resistive elements, and the plurality of light emitting diodes are three, respectively.

10. The condenser microphone according to claim 5, wherein the phase shift oscillator further includes an inverting amplifier and the RC network is connected between the output terminal and the input terminal of the inverting amplifier.

* * * * *